US005561982A

United States Patent [19]

Tunkel et al.

[11] Patent Number: 5,561,982

[45] Date of Patent: Oct. 8, 1996

[54] METHOD FOR ENERGY SEPARATION AND UTILIZATION IN A VORTEX TUBE WHICH OPERATES WITH PRESSURE NOT EXCEEDING ATMOSPHERIC PRESSURE

[75] Inventors: Lev Tunkel, Edison, N.J.; Boris Krasovitski, Nesher, Israel

[73] Assignee: Universal Vortex, Inc., Robbinsville, N.J.

[21] Appl. No.: 433,899

[22] Filed: May 2, 1995

[51] Int. Cl.[6] ..... F25B 9/02

[52] U.S. Cl. ..... 62/5

[58] Field of Search ..... 62/5

[56] References Cited

U.S. PATENT DOCUMENTS 3,319,347 5/1967 Bentley ..... 62/5
3,775,988 12/1973 Fekete ..... 62/5
4,584,838 4/1986 AbuJudom, II ..... 62/5

*Primary Examiner*—Ronald C. Capossela
*Attorney, Agent, or Firm*—McAulay Fisher Nissen Goldberg & Kiel, LLP

[57] ABSTRACT

A method of the energy separation and utilization in the Vortex Tube which operates with a pressure not exceeding the atmospheric, the system harnessing this method comprises a Vortex Tube and a vacuum pump with the Vortex Tube's nozzles connected with the inlet gas flow with the pressure not exceeding the atmospheric and the Vortex Tube's diaphragm with the hole for discharging the cold stream connected through the heat exchanger provided to utilize a cool duty with the suction section of the vacuum pump and, accordingly, the Vortex Tube's throttle valve or any other restrictive body for discharging of the hot stream at the far end of the slender tube connected through the heat exchanger provided to utilize a hot duty with the suction section of the vacuum pump.

11 Claims, 4 Drawing Sheets

METHOD FOR ENERGY SEPARATION AND UTILIZATION IN A VORTEX TUBE WHICH OPERATES WITH PRESSURE NOT EXCEEDING ATMOSPHERIC PRESSURE

BACKGROUND OF THE INVENTION

1. Field of the Invention

The present invention relates to cooling, heating and drying systems using a vortex tube as a source for energy separation.

2. Description of the Prior Art

It is well known to use a vortex tube for energy separation when the vortex tube is fed with a compressible fluid under positive (i.e., above atmospheric) pressure. Such a method is harnessed in a system and comprises a source of the compressed fluid connected with a vortex tube. In the vortex tube, the initial flow is transformed into two separate currents of different energy (a cold and a hot fraction) leaving the vortex tube separately under pressure which is less than the inlet pressure but at a pressure still above atmospheric.

A vortex tube comprises a slender tube with a diaphragm closing one end of the tube provided with a small hole in the center of the diaphragm, one or more tangential nozzles piercing the tube just inside of the diaphragm, and a controlled discharge opening such as throttle valve or any other restrictive body at the far or other end of the slender tube.

Since the disclosure of an early vortex tube design disclosed by Ranque in the U.S. Pat. No. 1,952,281 there have been many other inventors working in the field of vortex tube design; nevertheless, all of them have considered a vortex tube as a device whose function is to receive a flow of compressed gas through the tangential nozzles and to discharge a stream of cold gas, expanded to some positive pressure gas through a small hole in the diaphragm, and to discharge a stream of hot gas simultaneously through the valve. Both of the discharged gas streams from the vortex tube have a positive pressure.

In a vast majority of industrial applications of the vortex tube, a compressor is used as a source of its feeding flow. However, this creates problems which often make it difficult or even restrict these applications. In particular, there is quite a customary situation when a variety of relatively small vortex tube's based devices, such as cooling computer cabinets and/or personal heat relieve systems located in different places of an office in which different areas or spaces have to be fed with the compressed air. In this case, it is necessary to develop a sophisticated and expensive piping network throughout the building in addition to providing for the compressor installation.

On the other hand, should a compressor be incorporated into a cooling device, this requires the availability of a compressor's inter and/or after cooling system, in order to prevent a vortex feed from overheating. In the absence of such a system, which is typical for portable compressors, it has become necessary to provide a special heat exchanger and a separator prior to applying the gas before the vortex tube's nozzles.

Also, noise generated by the compressed gas expanding in the vortex tube causes a serious inconvenience for the environment, and thus requires a special adjustment of the vortex tube such as providing mufflers, or other sound absorbers, etc., which, however are able to reduce but not completely exclude such inconvenience.

It is therefore an object of this invention to avoid the above mentioned problems and disadvantages.

A further object of the invention is to provide a new method of vortex energy separation.

SUMMARY OF THE INVENTION

The present invention is concerned with a novel method of energy separation and utilization of such energy separated in the vortex tube which operates with a pressure not exceeding atmospheric pressure. This method is to be carried out with a vacuum pump, a vortex tube and at least one heat exchanger. Accordingly, the vortex tube's nozzles are connected with an inlet gas flow having a pressure not exceeding atmospheric pressure, and the vortex tube's diaphragm with the hole for discharging the cold stream is connected through a heat exchanger provided to utilize a cool duty with the suction section of the vacuum pump and, accordingly, the vortex tube's throttle valve or any other restrictive body for discharging of the hot stream at the opposite end of the slender tube is connected through the heat exchanger provided to utilize a hot duty with the suction section of the vacuum pump.

As indicated in the description of the prior art there are some serious technical restrictions in the commercial applications of the vortex tube's based devices fed with the compressed gas. Being aware of them we have come to the conclusion that it was necessary to investigate the vortex tube's ability to separate energy while being fed with the flow under pressure which does not exceed the atmospheric pressure. Having such of the vortex tube performance secured, one normally would see no problems with the vortex tube's based devices applications.

BRIEF DESCRIPTION OF THE INVENTION

The purpose of this invention is to develop a method of energy separation and energy utilization on the basis of the discovered vortex tube's ability to perform under the feeding gas pressure which does not exceed the atmospheric. While working with such pressure, the vortex tube and the vortex tube's based systems and devices are not believed to have any disadvantages which are typical of a vortex tube fed with the compressed gas.

In order that the invention may be readily carried into effect, the same will now be described with reference to the accompanying drawings:

DETAILED DESCRIPTION OF THE DRAWINGS

Figure 1:
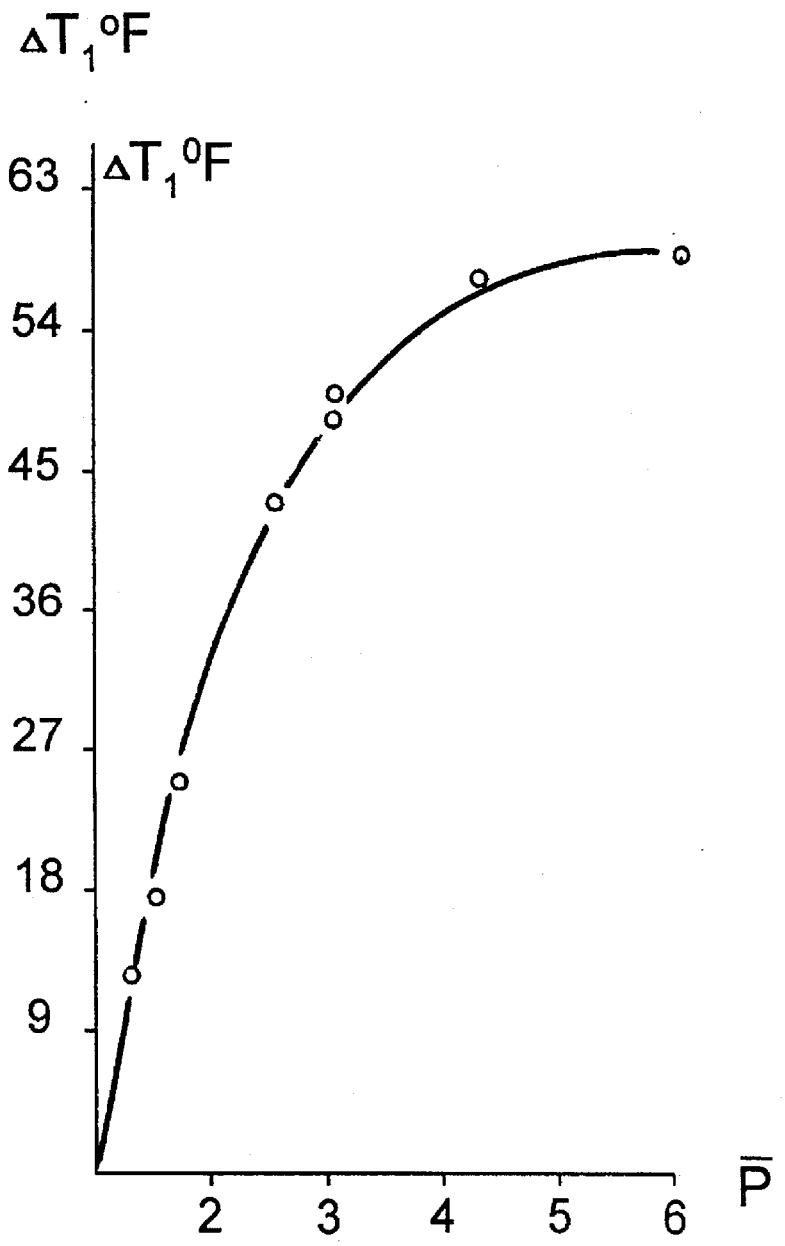
FIG. 1 is a graphical representation of the relation between $\Delta T_1$ value which is a difference of the inlet and cold fraction's gas temperatures and P (gas relative pressure) value. It was taken under fixed value of the cold fraction.
Figure 2:
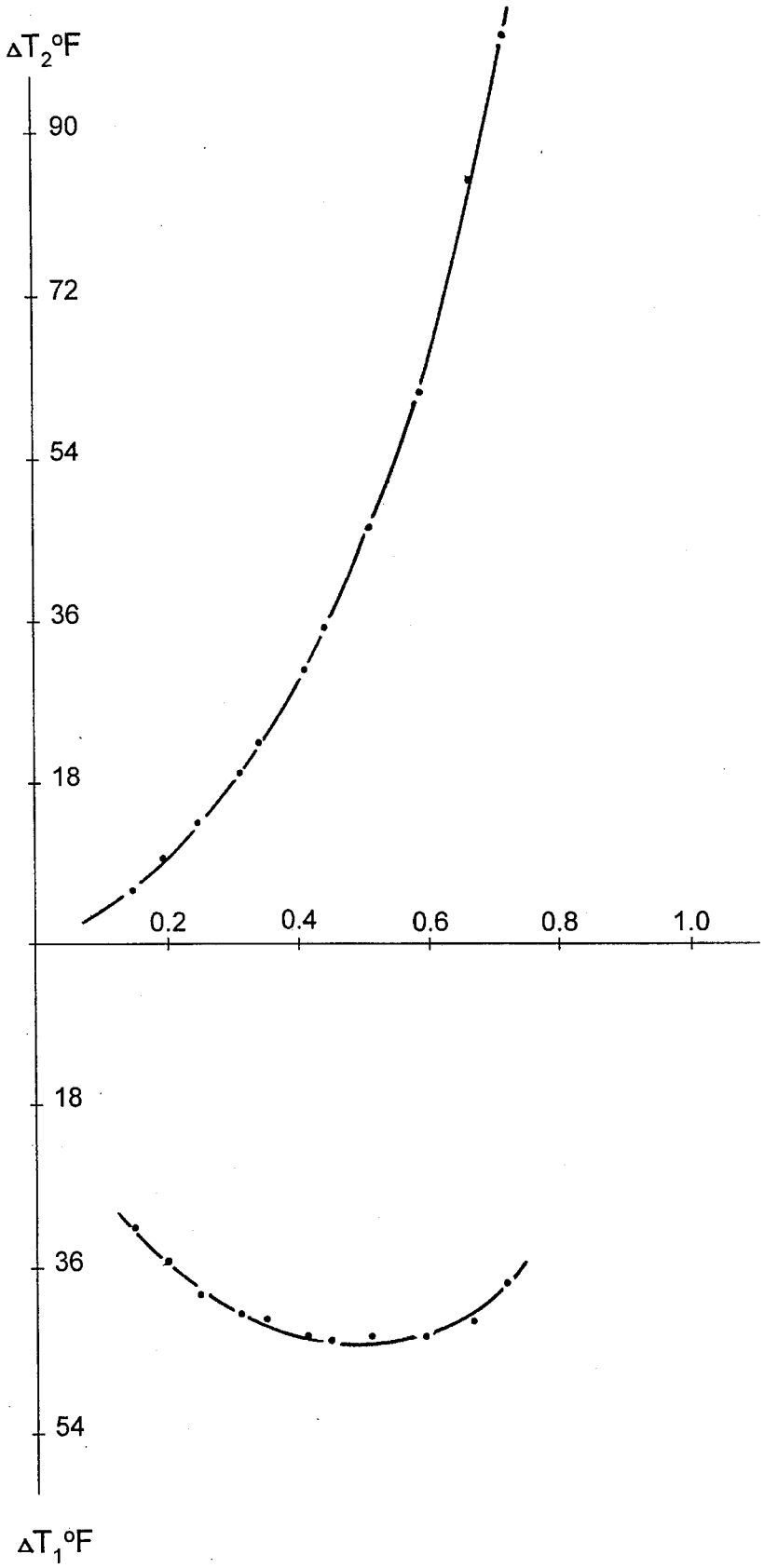
FIG. 2 is a graphical representation of the relation between $\Delta T_1$ and $\Delta T_2$ values taken simultaneously ($\Delta T_2$ is a difference of the hot fraction and inlet gas temperatures) and a value of the cold fraction M. It was taken under fixed value of the gas relative pressure.

FIGS. 1 and 2 are discussed in detail in connection with the verification of the performance of the vortex tube.

Figure 4:
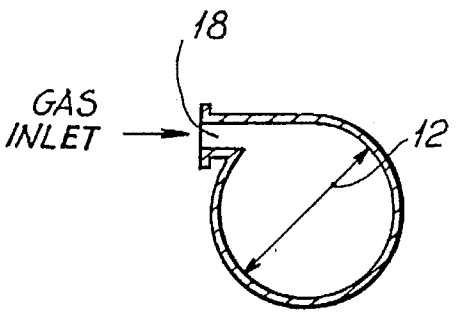
FIG. 4 is a cross-sectional view of the vortex tube taken on line 2—2 of FIG. 3.
Figure 3:
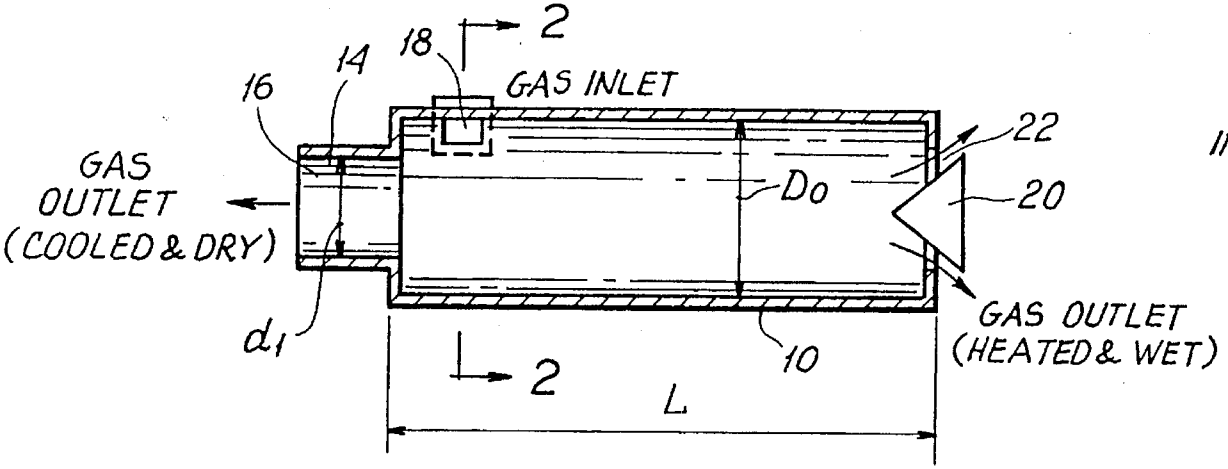
FIG. 3 is a side section view of a vortex tube taken on line 1—1 of FIG. 4.

Reference is made to FIGS. 3 to 6, and in particular to FIGS. 3 and 4 of the accompanying drawings, which show a vortex tube 10, for use in carrying out the invention. As best seen in FIGS. 3 and 4, vortex tube 10 has a length L, a cross-sectional diameter Do designated by the reference numeral 12, a diaphragm 14 closing one end of the tube 10 and provided with a hole or opening 16 having a diameter $d_1$, one or more tangential nozzles 18 providing for a gas inlet. Also provided is a valve or a valve member 20, which functions as a regulating valve to regulate the amount of gas flow. Gas outlet 22 is provided at an end opposite to gas outlet 16 for the outflow of heated and wet gas. Cool and dry gas flows out through outlet 16.

Figure 5:
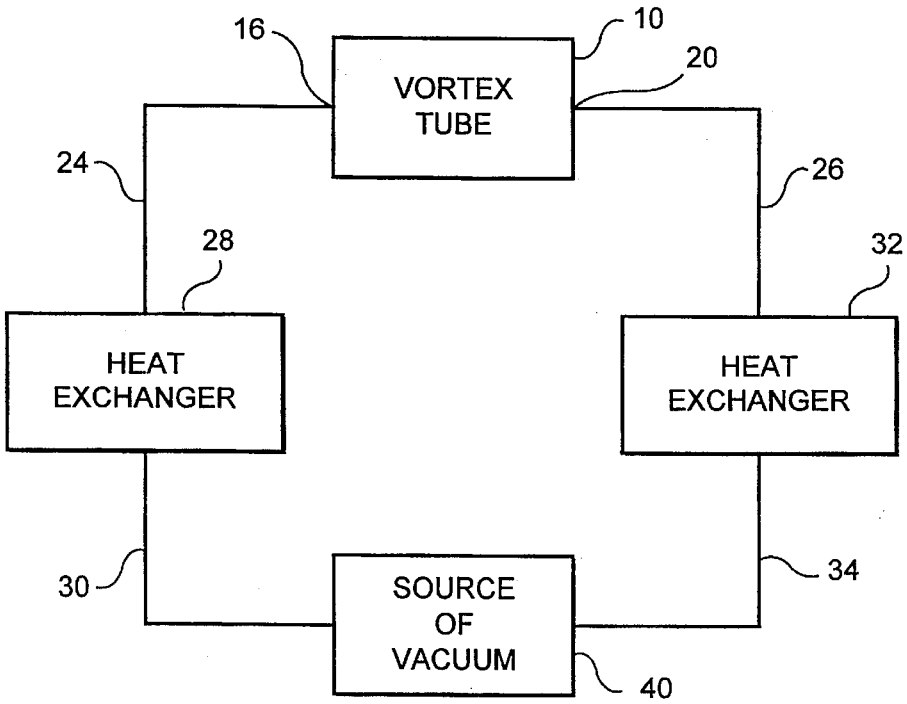
FIG. 5 is a schematic layout of a system for carrying out a method according to the invention in which a vortex tube is connected with two heat exchangers and the heat exchangers are connected with a source of vacuum, such as vacuum pump.
Figure 6:
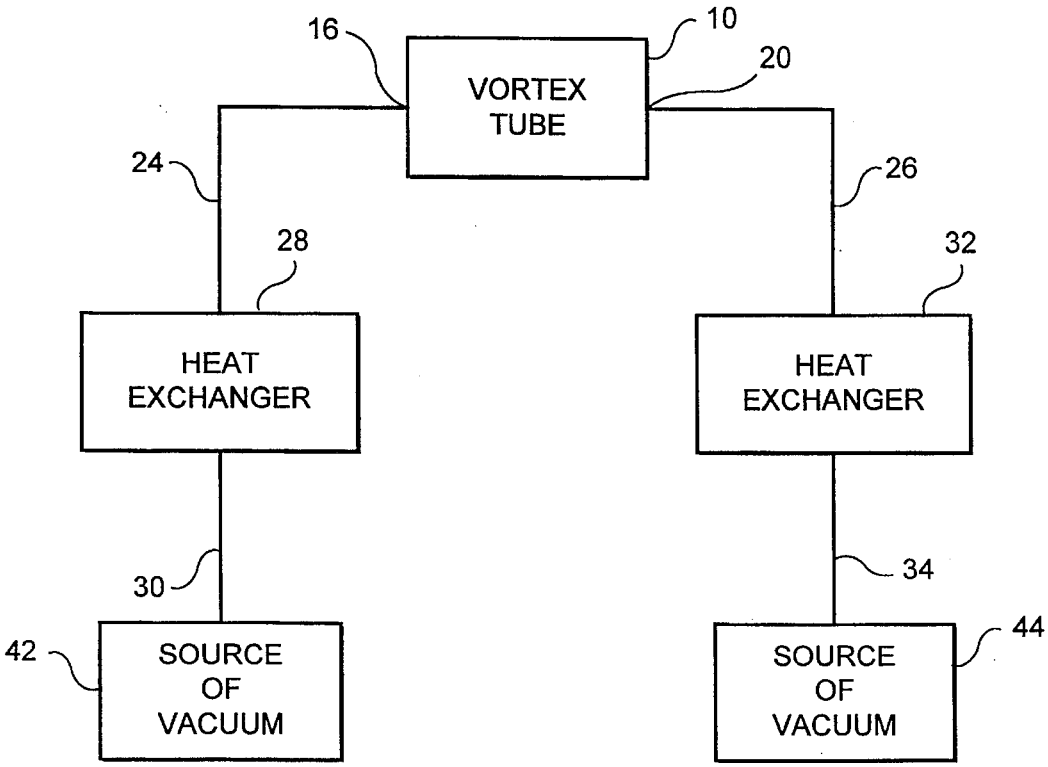
FIG. 6 is a schematic layout of another system for carrying out another method according to the invention in which a vortex tube is connected with two heat exchangers and each of the heat exchangers are connected with a source of vacuum, such as a vacuum pump, an internal combustion engine or an oil refinery processor.

Reference is now made to FIGS. 5 and 6.

In the method for energy separation and utilization in a vortex tube operating in response to a pressure not exceeding atmospheric pressure, a system such as that shown in FIG. 5 is useful and comprises the vortex tube 10 and at least one source of vacuum 40, such as a vacuum pump, an oil refinery processor or a combustion engine, the vortex tube includes a slender tube having the diaphragm 14 with hole 16 for discharging a cold stream which is carried in line 24 at one end of the slender tube and transferring it to a heat exchanger 28, and throttle valve 20 for discharging a hot stream which is carried in line 26 at the other end of the slender tube and at least one tangential inlet nozzle 18 (see FIGS. 3 and 4) coupled to the slender tube between the throttle valve and the diaphragm to heat exchanger 32.

Heat exchanger 28 has its output connected through line 30 with the source of vacuum 40. Heat exchanger 32 has its output connected through line 34 to the source of vacuum 40, for utilization of the hot duty. As noted, the source of vacuum 40 may be a pump, an oil refinery processor or an internal combustion engine. When a vacuum pump is used as the source of vacuum, the cold duty from heat exchanger 28 is utilized with the suction section of the vacuum pump, and the hot duty from heat exchanger 32 is utilized with the suction section of the vacuum pump.

It should also be understood that in FIG. 5, the outlet from heat exchanger 32 is applied through line 34 to source of vacuum 40, which may be an internal combustion engine or an oil refinery processor. The cold stream in line 24 discharged through the hole or opening 16 of the vortex tube's diaphragm 14 is connected through heat exchanger 28 provided to utilize a cool duty with a hot flow downstream its heat exchanger and the hot stream in line 26 discharged through the throttle valve/restrictive body 20 is connected through the heat exchanger 32 to utilize a hot duty with the cold flow downstream its heat exchanger then the cold and hot flows are combined into a united stream and applied to the suction section of the vacuum pump schematically shown as source of vacuum 40.

In FIG. 6, which differs from FIG. 5 in that two sources of vacuum 42, 44 are used, there is disclosed an arrangement in which the cold stream in line 24 is connected through heat exchanger 28 provided to utilize a cold duty with a separate source of vacuum 42 which can be for example the suction section of a first vacuum pump, and the hot stream in line 26 at the far end of the slender tube is connected through heat exchanger 32 provided to utilize the hot duty with a separate source of vacuum, which can be for example, the suction section of another vacuum pump.

DETAILED DESCRIPTION OF THE INVENTION

In order to verify the performance of the vortex tube, an experimental test was conducted. In our tests the vortex tube's nozzles either were connected with the atmospheric pressure air or in some of the experiments with the gas under vacuum, while the streams discharged from the vortex tube were connected in one of the following ways:

1. The stream leaving the vortex tube diaphragm and the stream leaving the throttle valve at the far end of the slender tube were combined and then connected and applied to the suction section of the vacuum pump.

2. The stream leaving the vortex tube diaphragm was connected to the vacuum pump while the stream leaving the throttle valve at the far end of the slender tube was connected to another vacuum pump.

During the experimental tests, the pressure and the temperature of the inlet and two outlet vortex tube's flows were measured.

We found that when the vortex tube is fed with the gas flow under a pressure which does not exceed the atmospheric pressure, the vortex tube is capable of separating the energy. And, as in the case of the vortex tube fed with compressed gas, to form the two separate flows; the "cold" stream leaves through the vortex tube diaphragm and the "hot" stream leaves through the throttle valve at the far end of the slender tube.

The intensity of the Vortex energy separation $AT_1$ and $AT_2$ measured by the value of the temperature differences ($\Delta T_1 = T_0 - T_1$, and $\Delta T_2 = T_2 - T_0$) at the fixed M value, in general, is increase with the rise of the vortex tube relative pressure ratio P, as it is shown on FIG. 1. Moreover, we have also found that under a fixed value for P the magnitudes of $\Delta T_1$ and $\Delta T_2$ are depend on the M value, although in different ways. FIG. 2 presents the typical experimental relations of $\Delta T_1$ and $\Delta T_2$ magnitudes to the M value at fixed P.

Here:

$T_0$=Temperature of the gas ahead of the vortex tube inlet nozzles;

$T_1$=Temperature at the "cold" gas downstream from the diaphragm;

$T_2$=Temperature of the "hot" gas downstream from the throttle valve.

M=Cold fraction or mass flow of cold gas divided by mass flow of the inlet gas.

$P_1$=vacuum gage absolute pressure downstream from the diaphragm.

$P_0$=inlet gas pressure, not exceeding the atmospheric pressure.

$P=P_0/P_1$, vortex tube relative pressure ratio, where $P_0$ is the inlet gas pressure (not exceeding the atmospheric), and $P_1$ is the absolute vacuum gauge pressure downstream from the diaphragm.

The utilization of the "cold" and the "hot" streams energy in the present method was achieved and is achieved in any further application by the means of heat exchangers attached to the vortex tube downstream of the diaphragm and to the vortex tube downstream of the throttle valve at the far end of the slender tube.

Also, due to the nature of the method presented, which requires energy for expanding the vortex inlet flow rather than for compressing it, a significant saving of energy (vacuum pump's vs. compressor's running vortex tube) was noticed while producing an equal amount of the cooling duty and heating duty under equal circumstances.

During our experiments, we found an equal efficiency of harnessing using the method schemes 1 and 2.

While we have set forth what we consider to be the preferred embodiments of the invention, various changes and modifications may be made therein without departing from the scope of the invention.

What is claimed is:

1. A method for energy separation and utilization in a vortex tube operating in response to a pressure not exceeding atmospheric pressure in a system comprising a vortex tube and at least one vacuum pump, the vortex tube including a slender tube having a diaphragm with a hole for discharging a cold stream at one end of the slender tube and a throttle valve for discharging a hot stream at the other end of the slender tube and at least one tangential inlet nozzle coupled to the slender tube between the throttle valve and the diaphragm, the method comprising:

connecting an inlet gas flow to at least one nozzle with a pressure not exceeding atmospheric pressure for supplying the gas to the vortex tube through the at least one inlet nozzle;

connecting the cold stream discharged from the vortex tube through the diaphragm with a hole to a heat exchanger provided to utilize a cold duty with a suction section of a vacuum pump; and connecting the hot stream discharged from the vortex tube through the throttle valve through another heat exchanger for utilizing a hot duty with the suction section of the vacuum pump.

2. The method of claim 1, wherein the throttle valve is a restrictive body.

3. The method of claim 1, including combining the cold and hot flows into a united stream connected to the suction section of the vacuum pump.

4. The method of claim 3, wherein the throttle valve is a restrictive body.

5. The method of claim 1, including discharging the cold stream connected through a first heat exchanger provided to utilize a cold duty with the suction section of a first vacuum pump, and discharging the hot stream at the far end of the slender tube connected through a second heat exchanger provided to utilize a hot duty with the suction section of another vacuum pump.

6. The method as claimed in claim 5, wherein the throttle valve is a restrictive body.

7. The method of claim 1, including connecting the cold stream discharged through the diaphragm to a first heat exchanger to utilize a cool duty with a hot flow downstream of the heat exchanger and connecting the hot stream discharged through the throttle valve to a second heat exchanger provided to utilize the hot duty with the cold flow downstream of the first heat exchanger, and after the cold and hot flows are combined into the united stream, the combined flows being connected to the suction section of the vacuum pump.

8. The method of claim 7, wherein the throttle valve is a restrictive body.

9. A method of the energy separation and utilization in a vortex tube which operates with a pressure not exceeding the atmospheric, the system harnessing this method comprises a vortex tube and a vacuum pump with a vortex tube's nozzles connected with the inlet gas flow with the pressure not exceeding the atmospheric and a vortex tube's diaphragm with a hole for discharging the cold stream connected through a heat exchanger provided to utilize a cool duty with the suction section of the vacuum pump and, accordingly, a vortex tube's throttle valve or any other restrictive body for discharging of the hot stream at the far end of the slender tube connected through another heat exchanger provided to utilize a hot duty with the suction section of the vacuum pump.

10. A method of the energy separation and utilization in a vortex tube which operates with a pressure not exceeding the atmospheric, the system harnessing this method comprises a vortex tube and a vacuum pump with a vortex tube's nozzles connected with the inlet gas flow with the pressure not exceeding the atmospheric and a vortex tube's diaphragm with a hole for discharging the cold stream connected through a heat exchanger provided to utilize a cool duty with the hot flow downstream its heat exchanger and a vortex tube's throttle valve or any other restrictive body for discharging of the hot stream at the far end of the slender tube connected through another heat exchanger provided to utilize a hot duty with the cold flow downstream its heat exchanger and after the cold and the hot flows are combined to form a united stream connected to a suction section of the vacuum pump.

11. A method of the energy separation and utilization in a vortex tube which operates with a pressure not exceeding the atmospheric, the system harnessing this method comprises a vortex tube and a source of vacuum with a vortex tube's nozzles connected with the inlet gas flow with the pressure not exceeding the atmospheric and a vortex tube's diaphragm with a hole for discharging the cold stream connected through a heat exchanger provided to utilize a cool duty with the source of vacuum and, accordingly, a vortex tube's throttle valve or any other restrictive body for discharging of the hot stream at the far end of the slender tube connected through another heat exchanger provided to utilize a hot duty with a source of vacuum.

* * * * *